US011660651B2

(12) United States Patent
Ingvarsson

(10) Patent No.: US 11,660,651 B2
(45) Date of Patent: May 30, 2023

(54) DEVICE AND METHOD FOR THE FLEXIBLE ROLL FORMING OF A SEMIFINISHED PRODUCT

(71) Applicant: METAL ENVELOPE GMBH, Hessigheim (DE)

(72) Inventor: Lars Ingvarsson, Borlänge (SE)

(73) Assignee: METAL ENVELOPE GMBH, Hessigheim (DE)

( * ) Notice: Subject to any disclaimer, the term of this patent is extended or adjusted under 35 U.S.C. 154(b) by 0 days.

(21) Appl. No.: 17/285,824

(22) PCT Filed: Oct. 7, 2019

(86) PCT No.: PCT/EP2019/077071
§ 371 (c)(1),
(2) Date: Apr. 15, 2021

(87) PCT Pub. No.: WO2020/078753
PCT Pub. Date: Apr. 23, 2020

(65) Prior Publication Data

US 2021/0379640 A1 Dec. 9, 2021

(30) Foreign Application Priority Data

Oct. 15, 2018 (DE) ..... 10 2018 125 517.9

(51) Int. Cl.
*B21D 5/08* (2006.01)

(52) U.S. Cl.
CPC ..... *B21D 5/083* (2013.01)

(58) Field of Classification Search
CPC .. B21D 5/09; B21D 5/083; B21D 5/06; B21B 31/08
See application file for complete search history.

(56) References Cited

U.S. PATENT DOCUMENTS 4,724,695 A * 2/1988 Stoehr ..... B21B 31/14 72/181
8,601,845 B2 12/2013 Ingvarsson
(Continued)

FOREIGN PATENT DOCUMENTS

DE 10011755 A1 9/2001
EP 1676654 A1 7/2006
(Continued)

OTHER PUBLICATIONS

Metal Envelope GMBH, International Search Report and Written Opinion, PCT/EP2019/077071, dated Dec. 20, 2019, 11 pgs.
(Continued)

*Primary Examiner* — Debra M Sullivan
(74) *Attorney, Agent, or Firm* — Morgan, Lewis & Bokius LLP

(57) ABSTRACT

The invention relates to a device (10) for the flexible roll forming of a semifinished product (12), in particular a rolled sheet, to form a profile (12', 12") with a cross section varying along the longitudinal axis thereof and/or with a varying longitudinal axis. The device (10) has a frame (14) and a number of supporting devices (16), which are carried by the frame (14). The supporting devices (16) are each movable in a translational manner in relation to the frame (14) and rotatably mounted. The device (10) also has a number of profiling units (18), which each have a pair (20) of rotatably mounted rollers (20', 20"), between which a rolling gap (102) remains. According to the invention, precisely two profiling units (18) are arranged in a rotatably mounted manner on each supporting device (16).

9 Claims, 5 Drawing Sheets

(56) References Cited

U.S. PATENT DOCUMENTS

| | | | | |
|---|---|---|---|---|
| 2004/0040357 | A1 | 3/2004 | Ingvarsson et al. | |
| 2009/0025446 | A1 | 1/2009 | Ingvarsson et al. | |
| 2010/0083722 | A1 | 4/2010 | Bachthaler et al. | |
| 2013/0276497 | A1 | 10/2013 | Ingvarsson | |
| 2014/0298876 | A1* | 10/2014 | Ingvarsson | B21B 31/20 72/226 |
| 2015/0027192 | A1* | 1/2015 | Lee | B21D 5/12 72/247 |
| 2019/0210084 | A1 | 7/2019 | Ingvarsson | |

FOREIGN PATENT DOCUMENTS

| | | | |
|---|---|---|---|
| EP | 2134484 | A1 | 11/2009 |
| SE | 1350012 | A1 | 6/2013 |
| WO | WO 2006/115447 | A1 | 11/2006 |
| WO | WO 2012091650 | A1 | 7/2012 |
| WO | WO 2018147773 | A1 | 8/2018 |

OTHER PUBLICATIONS

German application No. 10 2018 125 517.9, Office Action dated Sep. 12, 2019, 6 pgs.

* cited by examiner

DEVICE AND METHOD FOR THE FLEXIBLE ROLL FORMING OF A SEMIFINISHED PRODUCT

BACKGROUND OF THE INVENTION

1. Field of the Invention

The invention relates to a device and a method for the flexible roll forming of a semifinished product, in particular a piece of sheet metal, to form a profile with a cross-section which varies along its longitudinal axis and/or with a longitudinal axis which varies.

2. Description of the Prior Art

Devices of the type mentioned above have been used for many years in profiling technology when profiles with a cross-section which varies along their length and/or with a longitudinal axis which varies need to be produced from pieces of sheet metal which are usually wound as a continuous strip of sheet metal onto spindles, so-called coils. In the case of a profile with a longitudinal axis which varies, the latter does not run in a straight line but is curved in at least one plane.

With systems of this type, the desire for more and more unusual shapes of profiles which can be designed with as much freedom as possible, in particular in cladding and roofing technology, has been satisfied. These so-called free-form profiles are preferably used as covering elements for external cladding and roofs which must meet high demands in terms of shaping. Free-form profiles are in particular frequently used in construction projects with certain high architectural design values. Depending on the complexity of the free form of the cladding or the roof, it is possible for each individual profile used to have an individual shape.

In order to produce the required profiles as efficiently as possible, such flexible roll forming devices are usually brought directly to the construction site and sometimes are even operated directly on the relevant roof or on the relevant cladding.

Because they are used on site on a daily basis and are transported frequently, these mobile and flexible roll forming devices are subject to a high degree of stress and the maintenance and repair costs are correspondingly high.

In the case of stationary roll forming devices which cannot be moved from the place they are being used once this has been fixed, and in the case of mobile roll forming devices, a piece of sheet metal is transported and profiled in a manner known per se by driven profiling rolls. The profiling rolls, which lie very close to one another in space, thus transmit the forming forces required for shaping and transport to the piece of sheet metal by friction. The piece of sheet metal is thus conveyed through a rolling gap, formed between the profiling rolls, in which the forming forces required for the shaping are transmitted to the piece of sheet metal.

A device for roll forming longitudinally oriented components is known from DE 100 11 755 A1 which has a frame with multiple support devices which are carried by the frame. Each support device takes the form of a carriage and can be displaced in translation relative to the frame by means of threaded spindles. Arranged on each support device is a profiling unit, referred to as a framework half, which in each case has a pair of rotatably mounted rolls between which there is a rolling gap. Relatively small radii of curvature for the outer edges of profiles with cross-sections that change over the longitudinal axis can be generated using this known device.

A disadvantage of this design is that the profiling units occasionally start to vibrate relatively strongly during operation owing to the high forming forces that are required. This not only increases the noise and the susceptibility to material wear but also, in the worst case scenario, can have a negative effect on the processing accuracy.

EP 1 676 654 A1 discloses a roll forming system in which multiple support devices, referred to as forming station carriers, each carry three profiling units. In one embodiment, support devices with the profiling units carried by them can each be displaced in translation and rotated about a vertical axis of rotation.

By virtue of three profiling units being arranged respectively on one support device, the system as a whole is more stable than the device described in DE 100 11 755 A1. A disadvantage of this known roll forming system is that only relatively large radii of curvature of the profile outer edges can be obtained in the profiling plane containing the longitudinal direction. This is also the case when the profiling units can be adjusted individually, as proposed in EP 1 676 654 A1, because here too three profiling units are always fastened together to a support device.

Roll forming systems are moreover disclosed in EP 2 134 484 B1, WO 2012/091650 A1, and WO 2018/147773 which in each case have profiling units which can rotate independently of one another and are in each case attached individually to a separate framework part.

SE 135 00 12 A1 describes a roll forming system with pairs of profiling units. Two profiling units are in each case connected directly to each other and can be displaced relative to each other at right angles to the conveying direction. The two profiling units can be rotated together about a central axis of rotation which is arranged between the profiling units.

These designs can also start to vibrate strongly during operation owing to the high forming forces required, which can have a negative effect on the processing accuracy in addition to the increased noise and susceptibility to material wear.

SUMMARY OF THE INVENTION

The object of the invention is therefore to provide a device and a method for the flexible roll forming of a semifinished product which overcomes the above-described disadvantages from the prior art and enables the production of free-form profiles with very small radii of curvature with low-vibration operation.

This object is achieved according to the invention with a device for the flexible roll forming of a semifinished product, in particular a piece of sheet metal, of the type mentioned at the beginning which has a frame. Multiple support devices are carried by the frame, wherein the support devices are in each case mounted so that they can be displaced in translation and rotated relative to the frame. The device moreover has multiple profiling units which each have a pair of rotatably mounted rolls, between which there is a rolling gap which is dimensioned such that a semifinished product, in particular a piece of sheet metal, can be conveyed by friction with the rolls in a conveying direction and at the same time roll formed.

Whereas in each case three profiling units are carried by a common support device in the case of the devices which are known from the document EP 1 676 654 A1 mentioned at the beginning, in the device according to the invention precisely two profiling units are arranged, rotatably mounted, on each support device. Profiles can consequently be generated with the device according to the invention with outer edges which can have smaller radii of curvature than in the case of the known device. This is because the third profiling unit here significantly restricts the possible radii of curvature.

Compared with the device known from DE 100 11 755 A1, the device according to the invention has the advantage that in each case two profiling units are connected to each other via a support device and consequently form an inherently rigid combination despite the ability of the profiling units to rotate individually. The support device, which carries two profiling units compared with the known device and therefore necessarily has a greater extent, can for its part be supported on the frame at opposite ends, which reduces the risk of tilting oscillations owing to the forming forces. A more rigid structure is consequently obtained overall with the device according to the invention, which enables low-vibration operation.

The device according to the invention thus represents an optimal compromise in terms of the achievable radii of curvature for the profile outer edges, on the one hand, and a low-vibration structure, on the other hand.

When only one side of the semifinished product needs to be profiled, an arrangement of the support devices in a straight or curved line is sufficient. However, especially in cladding and roofing technology, profiles are required which are profiled at both longitudinal sides by roll forming.

When roll forming a profile on both sides, the support devices and the profiling units mounted thereon are, in an idle state of the device, preferably arranged in two rows which extend essentially parallel to each other and essentially parallel to a profiling plane. Alternatively, the two rows of support devices can diverge, converge, or be arranged irregularly in the conveying direction. It is also possible to arrange the support devices offset relative to one another heightwise in the conveying direction.

The profiling plane is defined by the orientation of the semifinished product which is being introduced into the device. Whilst the longitudinal axis and the cross-section of a semifinished product to be roll formed can vary during the duration of the conveying and forming, the profiling plane which is defined when the semifinished product is introduced into the device remains the same even when the height of the support devices changes.

In order to be as flexible as possible in the design of profiles with cross-sections which vary along the longitudinal axis and/or with longitudinal axes which vary, the inventor has identified that it is favorable if the support devices and the profiling units carried by them have multiple independent translational and rotational degrees of freedom. Independent degrees of freedom are understood to be axes of rotation and translational movement about or along which at least one element of the support devices, the profiling units, or the frame can be displaced rotatably or in translation.

At least one support device is preferably mounted so that it can rotate about a first axis of rotation which is arranged parallel to a first direction of rotation. At least one profiling unit is mounted so that it can rotate about a second axis of rotation which is arranged parallel to a second direction of rotation. The support device can be displaced in translation parallel to a direction of translational movement, wherein the first direction of rotation encloses a first angle, which is preferably 90°, with the direction of translational movement, and the second direction of rotation encloses a second angle with the direction of translational movement. The second axis of rotation extends in each case through a processing point in the rolling gap between the pair of rotatably mounted rolls of the at least one profiling unit.

By virtue of this position of the second axis of rotation, the pair of rolls of each profiling unit can be oriented such that the processing point is positioned optimally with respect to the profile outer edge of the semifinished product to be roll formed. This in turn enables a particularly precise degree of processing accuracy.

In one embodiment, the pairs of rotatably mounted rolls in each case comprise a first roll and a second roll, which differs from the first roll, wherein the first and second rolls have in each case at least one first forming section revolving circumferentially and one second forming section, arranged offset thereto in the axial direction and revolving circumferentially. The processing point is then situated at the transition from the first forming section to the second forming section. The transition can here itself take the form of, for example, a conical third forming section.

In order to keep the structure of the device as simple as possible, it is advantageous if the first and second axes of rotation each extend essentially parallel to each other and the direction of rotation of the axes of rotation is essentially orthogonal to the direction of translational movement of the axes of translational movement. It is, however, also possible for the first and second axes of rotation and the axes of translational movement are oriented completely differently and hence there are a plurality of directions of rotation and a plurality of directions of translational movement for the support devices and the profiling units. The rotational and displacement behavior, which are thus asymmetrical, and/or the skewed axes of rotation and translational movement of the support devices and profiling units can be compensated, for example, by inclined components of the frame and/or varying geometrical basic shapes of the support devices and/or of a further axis of rotation. Such a further axis of rotation can be, for example, a horizontal axis of rotation for inclining the profiling units toward the semifinished product to be profiled or away from the semifinished product to be profiled. Compensation is here understood to mean that the same profile shapes can be obtained.

It is favorable if the first and second axes of rotation are in each case arranged eccentrically with respect to the respective geometrical central axis because, on the one hand, the support devices can hence pivot out further and, on the other hand, the angular positions of the profiling units can be adapted more precisely to the moving profile outer edge of the semifinished product.

The eccentricity is preferably large enough that when the support devices in each case have an elongated basic shape with at least two shorter opposite sides, the first axis of rotation in each case extends through a point of the support devices which is spaced at least twice as far from one of the two shorter sides as from the respective other side. When the profiling units in each case have an elongated basic shape with at least two shorter opposite sides, the second axis of rotation accordingly extends in each case through a point of the profiling units which is spaced at least twice as far from one of the two shorter sides than from the respective other side.

Both with respect to the first axes of rotation and with respect to the second axes of rotation, the ratio of the distances of the axes of rotation from the respective sides is in each case preferably in a range of 2:1 to 25:1, but particularly preferably in a range of 5:1 to 15:1.

In order to make the device generally more stable in such a way that it does not start to vibrate undesirably owing to forming forces which are caused by compressive, tensile, and shearing forces at the forming points, in one embodiment the support devices are in each case mounted in a supporting fashion on at least two support device bearing points.

In a development, the support devices can, however, also have three support device bearing points instead of two. In order to use the available space efficiently, the support devices can each have two first support elements, wherein the two first support elements provide a first support device bearing point and a second support device bearing point. The support devices moreover in each case have a first rotating element which defines the first axis of rotation and provides a third support device bearing point.

In order to further increase the stability with respect to forming forces, it is also possible to mount the profiling units in a supporting fashion in each case on at least two profiling unit bearing points.

It is also possible here for the profiling units to have three instead of two profiling unit bearing points. The profiling units can here in each case have two second support elements, wherein the two second support elements provide a first profiling unit bearing point and a second profiling unit bearing point. Each profiling unit has a second rotating element which defines the second axis of rotation and provides a third profiling unit bearing point.

The second pivot drives can, for example, in each case have a first transmission element, for example a curved toothed rack which engages with a second transmission element, in particular a toothed wheel. The two transmission elements can here be arranged at a greater distance from the second axis of rotation.

The semifinished products, in particular pieces of sheet metal, which are to be roll formed in the system can preferably have ductile materials such as aluminum (Al), manganese (Mn), zinc (Zn), titanium (Ti), iron (Fe), or alloys of these materials. The semifinished products to be roll formed particularly preferably have aluminum (Al) and aluminum alloys. Elementary aluminum and aluminum alloys with a high aluminum content (for example, more than 75 atomic %) have the particular property of forming, in contact with oxygen, a passivating protective layer of aluminum oxide (AlO) or boehmite (AlO(OH)) which is impermeable to air, water, and a broad spectrum of light. This passivating protective layer thus protects the aluminum underneath it or the aluminum alloy underneath it from corrosion. Because this is a naturally occurring process, these materials are particularly suited for being further processed to form profiles which are used later in external areas.

In the method according to the invention for the flexible roll forming of a semifinished product, in particular a piece of sheet metal, to form a profile with a cross-section which varies along its longitudinal axis and/or a profile with a longitudinal axis which varies, the abovementioned object is achieved by the following steps:

a) Providing a frame and a plurality of support devices carried by it, wherein the support devices each have precisely two profiling units which each have a pair of rotatably mounted rolls between which there is a rolling gap;

b) Displacing in translation and rotating the support devices relative to the frame and rotating the precisely two profiling units on the respective support device whilst the semifinished product is conveyed through the rolling gap in a conveying direction.

The advantages mentioned for the device apply correspondingly for the method.

In a preferred development of the method, a device is used which comprises some or all of the abovementioned features.

BRIEF DESCRIPTION OF THE DRAWINGS

Embodiments of the invention are explained in detail below with the aid of the drawings, in which.

DESCRIPTION OF PREFERRED EMBODIMENTS

Figure 1:
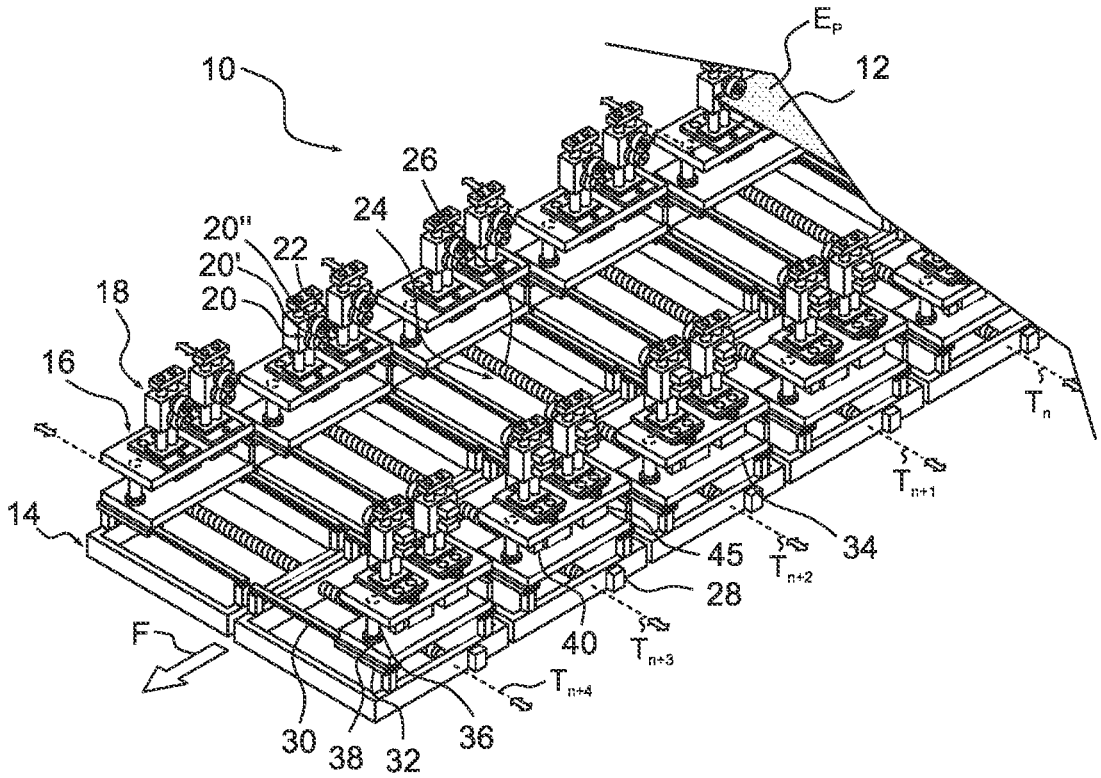
FIG. 1 shows the device according to the invention in a perspective view.
Figure 6A:
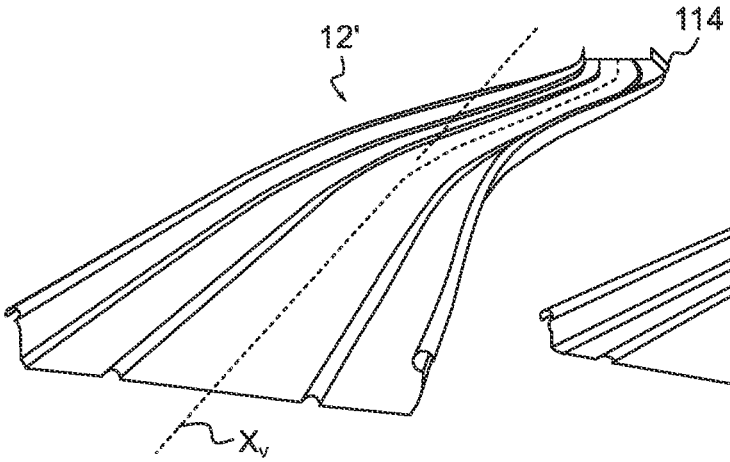
FIGS. 6*a* and 6*b* show embodiments of a profile with a cross-section which varies over the longitudinal axis and a profile with a longitudinal axis which varies.
Figure 6B:
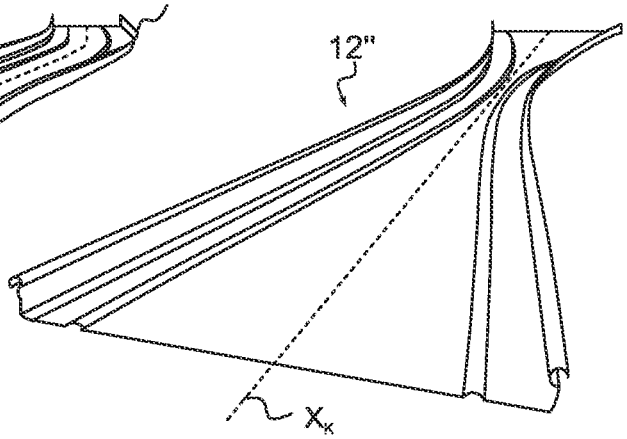

FIG. 1 shows a device, designated as a whole by 10, for the flexible roll forming of a semifinished product 12 which in the embodiment shown is a piece of sheet metal. The roll forming produces from the semifinished product 12 a profile which has a cross-section which varies along its longitudinal axis and/or a longitudinal axis which varies. An example of a profile with a longitudinal axis which varies is shown in FIG. 6*a*, which is explained below, and designated by 12'. FIG. 6*b* shows a profile 12" with a cross-section which varies along its longitudinal axis.

In the embodiment shown, a frame 14 which carries a plurality of support devices in the form of plate-like pivot tables 16 extends in a conveying direction F. Each pivot table for its part carries precisely two profiling units 18. A pair of rolls 20', 20" which serve to profile the semifinished product 12 in a manner known per se are in each case rotatably mounted on the profiling units 18.

The pivot tables 16 and the profiling units 18 carried by them are here arranged in two rows extending essentially parallel to each other and parallel to the conveying direction F. As can be seen best in the enlarged detail in FIG. 2, the profiling units 18 are oriented such that end faces 22 of the profiling rolls 20', 20" are oriented orthogonally with respect to the conveying direction F and face one another in pairs.

In embodiments which have not been shown separately, the pivot tables 16 and hence also the profiling units 18 carried by them are arranged in an alternating fashion relative to one another, for example in a zig-zag pattern. It is moreover not essential for the realization of the invention that the profiling units 18 are arranged in two rows extending essentially parallel to each other, in rows parallel to the conveying direction F, or with the end faces 22 of the profiling rolls 20', 20" orthogonally with respect to the latter. It is moreover conceivable to arrange the profiling units 18 at different heights or inclined to the vertical. Depending on the specific area of application, place of use, or shape of profile, the profiling units 18 can be arranged and/or tilted in almost any three-dimensional orientation, wherein each profiling unit 18 can be oriented and/or positioned individually.

The profiling device 10 is provided and configured to convey a semifinished product 12 in the conveying direction F and thus profile it in order to obtain the profile 12', 12". In this context, profiling should be understood to mean any type of change of shape made to the semifinished product 12, in particular a piece of sheet metal, which is flat when inserted into the device 10 and is up to 5 mm thick.

For this purpose, any combination of pivot table 16 and profiling units 18 can be moved with at least two degrees of freedom, namely can be displaced in translation and can be pivoted.

Figure 2:
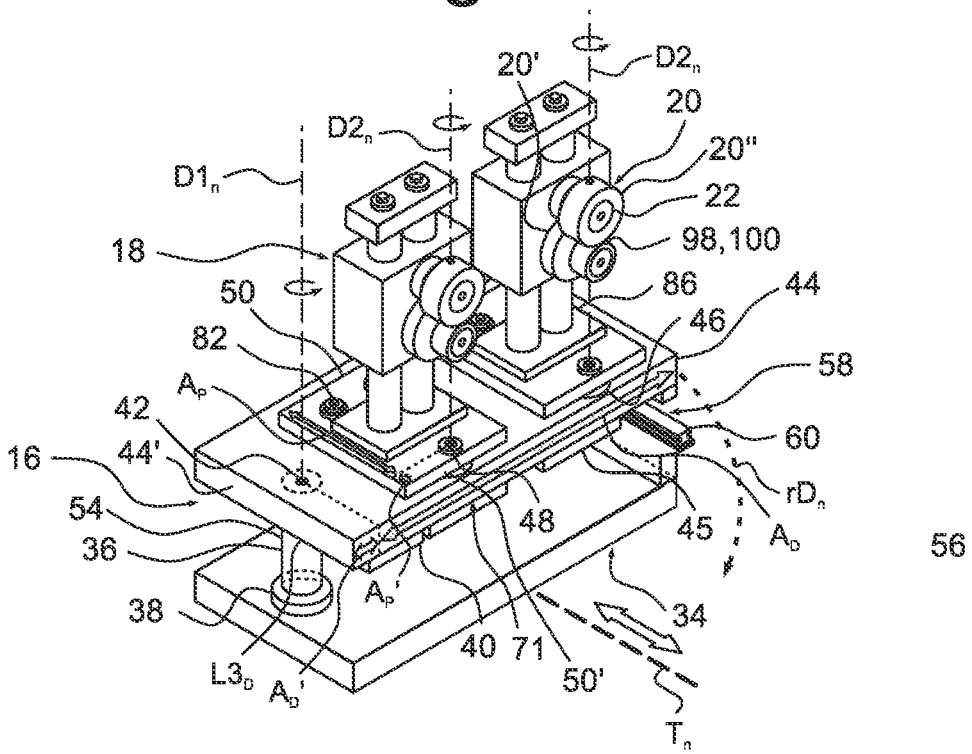
FIG. 2 shows a perspective view of a combination of a support device and two profiling units carried by it which each have a pair of corresponding profiling rolls.

As can be seen best in FIG. 2, in the embodiment shown, the pivot tables 16 carried by the frame 14 can each be displaced along an axis $T_n$ of translational movement which here extends at right angles to the conveying direction F. The pivot tables 16 can furthermore pivot about a first axis $D1_n$ of rotation, wherein n≥2 for the nth combination of a pivot table 16 and two profiling units 18.

Each pivot table 16 can be displaced along the axes $T_n$ of translational movement by means of a translational movement drive 24. In the present embodiment, the pivot table 16 is thus displaced along the axis $T_n$ of translational movement in each case by means of a ball screw 26 which extends parallel to the axis $T_n$ of translational movement. To effect this, the ball screw 26 is set in rotation by an electric motor 28. This causes a translational movement of the pivot table 16 along the ball screw 26 in a manner known per se.

It is, however, also possible to use a roller screw drive, a hydraulic or pneumatic cylinder, a linear motor, or another electromechanical linear drive to generate motorized linear movement along the axes $T_n$ of translational movement.

The pivot tables 16 are in each case mounted so that they can be displaced directly in translation on two lateral rail elements 30 which are formed on the frame 14. The two rail elements 30 have here, by way of example, an I-shaped profile which is comprised of rail guides 32 and forms a sliding bearing with the latter. Guides with rolling bearings can of course be used as an alternative.

In the present embodiment, each combination of support device 16 and the two profiling units 18 is arranged on a carrier element which is arranged between the frame 14 and the support device 16 and which in the present case takes the form of a plate-like carrier table 34. The rail guides 32 are formed on the underside of the carrier tables 34, as a result of which each carrier table 34 can be displaced in translation, together with the pivot table 16 carried by it, relative to the frame 14 along the axis $T_n$ of translational movement. A carrier element, which does not necessarily have to take the form of a carrier table, is required to make it possible for the respective pivot table 16 to be displaced in translation and pivoted independently of one another.

As can best be seen in FIG. 2, each pivot table 16 has a first rotating element in the form of a first axial rotating shaft 36 which is accommodated rotatably in a rotating bearing 38 of the carrier table 34. The rotating shaft and the rotating bearing 38 together define the first axis $D1_n$ of rotation of the pivot table 16 which for its part extends parallel to a first direction of rotation.

The pivot table 16 can be pivoted about the first axis $D1_n$ of rotation relative to the carrier table 34 and hence also relative to the frame 14 by means of a first pivot drive 40. The pivoting movement is here generated in a motorized fashion by the pivot drive 40. In FIG. 2, the pivot drive 40 is only indicated schematically. The pivot drive can, for example, comprise a hydraulically activated lever which connects the carrier table 34 to the pivot table 16. A drive employing a ball screw can also be considered for generating the pivoting movement.

The first axis $D1_n$ of rotation extends through a point 42 of the elongated pivot table 16 which is at a distance $A_D$ from one side 44 of two shorter opposite sides 44, 44' which is at least twice the distance $A_D'$ from the respective other side 44'.

In the present embodiment, the two profiling units 18 can likewise be pivoted by means of a second pivot drive 45 about second axes $D2_n$ of rotation which are each defined by second rotating elements in the form of second axial rotating shafts 46. Similarly to the first axes $D1_n$ of rotation, the second axes $D2_n$ of rotation each extend through a point 48 of the profiling units 18 which is at a distance $A_P$ from one side 50 of two shorter opposite sides 50, 50' which is more than twice the distance $A_P'$ from the respective other side 50'.

This eccentric arrangement of the second axes $D2_n$ of rotation causes different rotatory pivoting paths of the two sides 50, 50'. An actuator arranged on the side 50 with the longer pivoting path can consequently, owing to the longer lever, particularly precisely adjust the pivoting angle of the profiling unit 18 and hence the rolls 20', 20".

Figure 3:
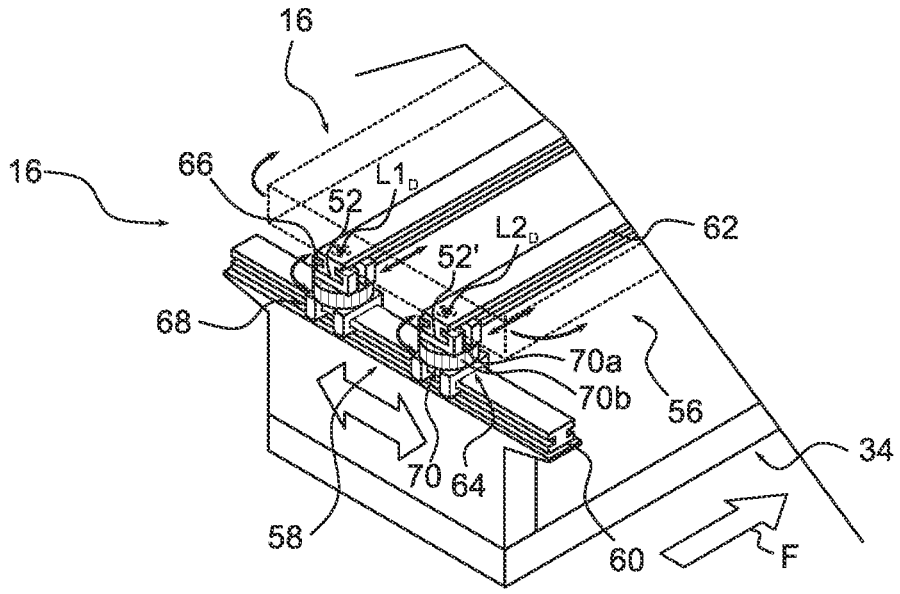
FIG. 3 shows a perspective view of an embodiment of a first pivot drive for pivoting the support devices.

A region 56 between the pivot table 16 and the carrier table 34 is shown in FIG. 3. In order to increase the mechanical strength and reduce vibrations, each pivot table 16 has according to the invention at least two, and in the present embodiment three, support device bearing points $L1_D$, $L2_D$, and $L3_D$ on which the pivot table 16 is mounted in a supporting fashion and which are provided by three support elements 52, 52'; 54.

A parallelogram pivot mechanism 58 arranged between the pivot table 16 and the carrier table 34 can moreover be seen in FIG. 3 which provides the first two support device bearing points $L1_D$, $L2_D$. For the purpose of dual mounting, the parallelogram pivot mechanism 58 has a first guide element, in the form of a transverse rail element 60, which is fastened on the carrier table 34 and extends transversely to the conveying direction F, and two second guide elements, in the form of longitudinal rail elements 62, which are fastened on the pivot table 16 and extend in the conveying direction F. However, the transverse rail element 60 can alternatively also take the form of rail elements 30 provided by the frame 14.

The transverse rail element 60 and the longitudinal rail elements 62 are displaceably connected to each other by two pivot elements in the form of guide carriages 64, wherein the guide carriages 64 are arranged so that they can each be displaced along the rail elements 60, 62. For this purpose, the guide carriages 64 have first connecting means which take the form of transverse grippers 66 and grip the longitudinal rail elements 62, and second connecting means which take the form of longitudinal grippers 68 and grip the transverse rail elements 60. These grippers 66, 68 have the effect that the guide carriages 64 cannot be detached from the rail elements 60, 62 by virtue of a tensile force which acts essentially in the opposite direction to the direction of gravitational force or at an angle $\alpha<90°$ to this direction. To do this it would be necessary to retract the guide carriages 64 from the rail elements 60, 62 in the respective direction of displacement.

The pivot table 16 is consequently connected positively and particularly stably to the carrier table 34, which counteracts the formation of vibrations.

So that the pivot table 16 can perform a rotational or pivoting movement, the guide carriages 64 have rotating structures 70 which take the form of a pair of axial rotating cylinders 70*a*, 70*b* in the present embodiment, wherein in each case one rotating cylinder 70*a* projects into the respective other rotating cylinder 70*b* in such a way that a rotation of the rotating cylinders 70*a*, 70*b* relative to each other is enabled. When the pivot table 16 pivots counterclockwise, both guide carriages 64 move away from an observer, wherein the rotational movement of the pivot table 16 is effected by a combination of a rotatory twisting of the rotating cylinders 70*a*, 70*b* relative to each other and a translational movement of the guide carriages 64 along the longitudinal rail elements 62. Clockwise pivoting correspondingly requires the reverse movement sequence of the elements of the parallelogram pivot mechanism 58.

As can best be seen in the side view in FIG. 4, the second pivot drive 45 is arranged below the profiling unit 18 in the present embodiment. In the perspective view in FIG. 5*a* and the plan view in FIG. 5*b* it can be seen that the second pivot drive 45 in each case has a first and a second drive element which here takes the form of a toothed wheel 72 or a curved toothed rack 74 which meshes with the toothed wheel 72. The curved toothed rack 74 is fastened to a support base 86 of the profiling unit 18 by fastening means 82 and via axial bores 84.

Figure 4:
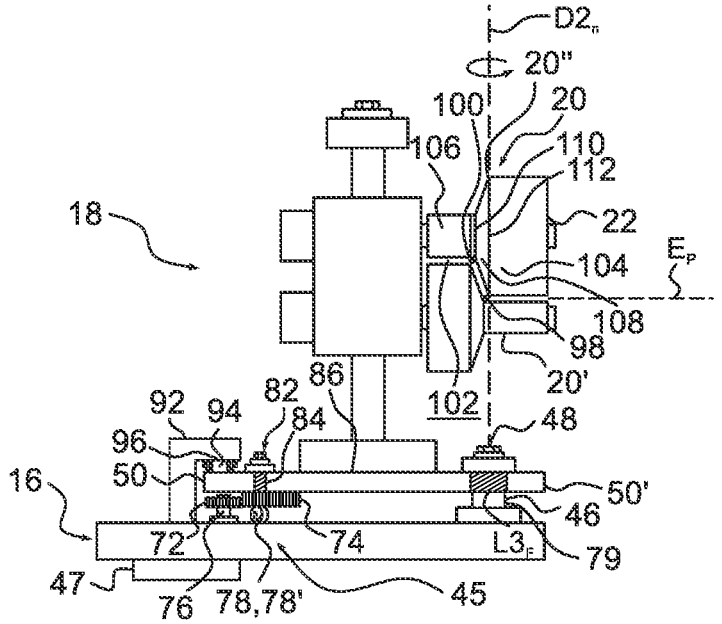
FIG. 4 shows a view in longitudinal section of a profiling unit according to the invention with part of an upper support region of a support device by which the profiling unit is carried.
Figure 5A:
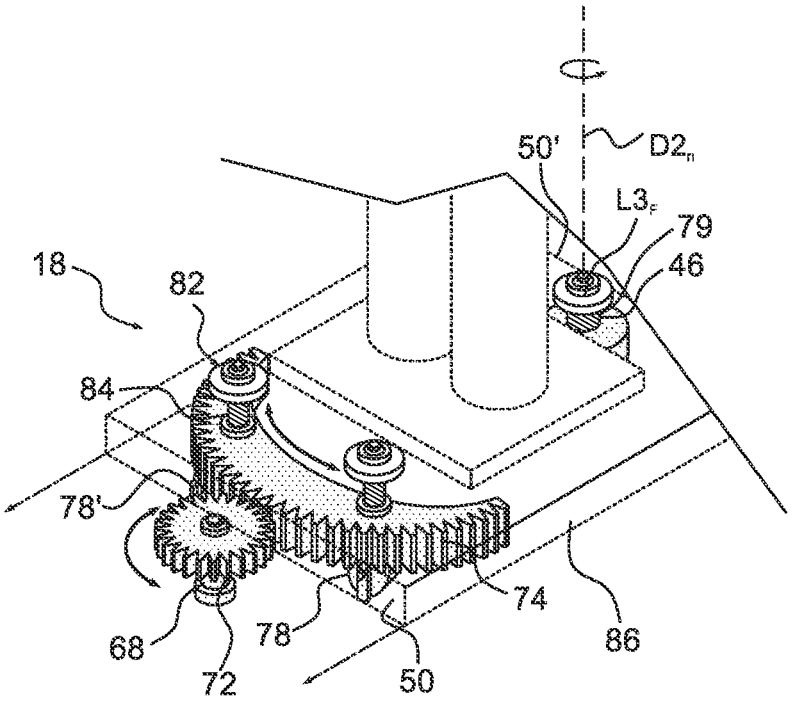
FIG. 5*a* shows a perspective view of an embodiment of a second pivot drive for pivoting the profiling units.
Figure 5B:
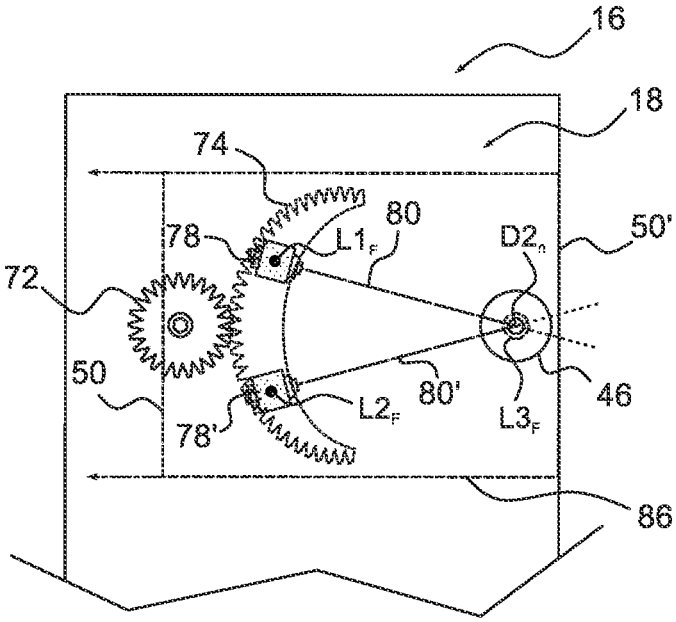
FIG. 5*b* shows a plan view of the embodiment of the second pivot drive.

A toothed wheel 72, which is driven by a motor 47 shown in FIG. 4 via a toothed wheel axial pin 76, is fastened on the pivot table 16. Rotation of the toothed wheel 72 causes the profiling unit 18 to pivot about the second axis $D2_n$ of rotation.

When the profiling unit 18 makes a pivoting movement generated by the toothed wheel 72, the curved toothed rack 74 runs on pivot rolls 78, 78' which form second support elements and are fastened on the pivot table 16 below the curved toothed rack 74. The directions of rotation of the axes 80, 80' of rotation of the pivot rolls 78, 78' here run essentially through the second axis $D2_n$ of rotation. In contrast to a parallel orientation of the axes 80, 80' of rotation relative to each other, this has the effect that the curved toothed rack 74 can roll on pivot rolls 78, 78' with less frictional resistance.

In the present embodiment, the pivot rolls 78, 78' have a further function in addition to the reduction of friction: they provide a first profiling unit bearing point $L1_P$ and a second profiling unit bearing point $L2_P$ for the profiling unit 18. The second axial rotating shaft 46 which is connected both to the pivot table 16 and to the profiling unit 18 forms a third support element 79 of the second support elements 78, 78'; 79 and thus provides a third profiling unit bearing point $L3_P$. The three profiling unit bearing points $L1_P$, $L2_P$, and $L3_P$, which are situated relatively far apart from one another, absorb the static and dynamic forces and contribute to the stability of the device 10.

As can be seen in FIG. 4, the profiling units 18 each have a framework element in the form of a bracket 92 on which in each case two second pivot rolls 94 are fastened which provide two counter bearing points 96. Together with the abovementioned pivot rolls 78, 78' on the underside of the toothed rack 74, the two further pivot rolls 94 secure the profiling unit 18 from tilting about a tilt axis arranged at right angles to the paper plane when forming forces act on the rolls 20', 20" in a vertical direction. The tendency to undesired vibration is also reduced by this measure.

As can be seen in FIGS. 2 and 4, the axis $D2_n$ of rotation about which the profiling units 18 can pivot runs through a processing point 98, 100 which is situated in a rolling gap 102 formed between the pair 20 of rolls 20', 20" of the profiling units 18.

The rolls 20', 20" each have multiple sections: a first forming section 104 revolving circumferentially and a second forming section 106 revolving circumferentially and different from the latter. A third forming section 108 revolving circumferentially and different from the forming sections 104, 106 can furthermore in each case be formed at the transition from the first forming section 104 to the second forming section 106.

A first forming edge 110 which transmits a large part of the forming forces required for the profiling to the semifinished product 12 to be profiled can be formed at the transition from the first forming section 104 to the second forming sections 106. In the present embodiment, the transition forms the third forming section 108. An additional second forming edge 112 is correspondingly formed at the transition from the third forming section 108 to the second forming section 106.

In the particularly preferred embodiment shown in FIG. 4, the axis $D2_n$ of rotation runs through the processing point 98, 100 which is situated on one of the forming edges 110, 112. The angle of the profiling units 18 can thus be adapted optimally to a progressive and changing profile outer edge 114 to be profiled because the profiling units 18 can always be pivoted exactly about one of the forming points 98, 100 when the curvature of the profile outer edge 114 to be profiled changes.

Shown by way of example in FIG. 6 in each case is a profile 12' manufactured from a semifinished product 12 with a cross-section which varies along its longitudinal axis $L_K$ and a profile 12" with a longitudinal axis $X_V$ which varies. Not shown separately are profiles which have both a longitudinal axis $X_V$ which varies and a cross-section which varies over the longitudinal axis $X_V$ which varies, although the device 10 is likewise suited to produce profiles of this type.

Longitudinal axes $X_V$ which change are understood in this context to mean continuous longitudinal axes $X_V$ with a curvature. The longitudinal axes $X_V$ can here have curvatures not only in two dimensions but also in three dimensions.

Figure 7:
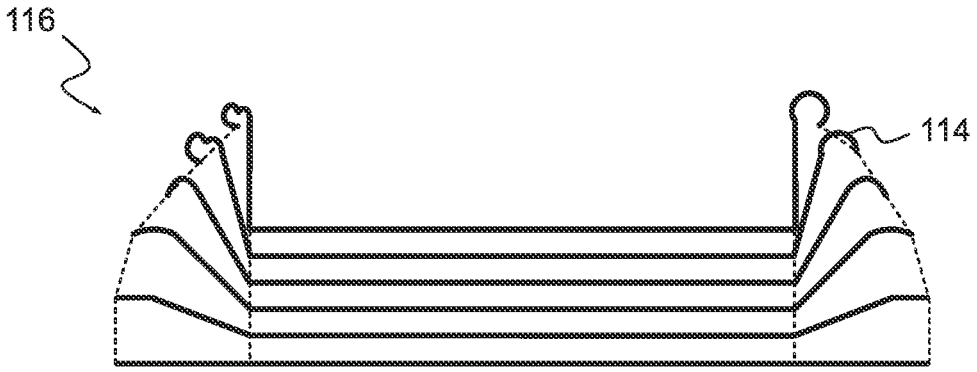
FIG. 7 shows an embodiment of a flower pattern required to create a profile.

A possible flower pattern designated by 116 is shown by way of example in FIG. 7 which illustrates in a simplified view different profiling steps for profiling a profile 12', 12". A separate pair 20 of corresponding profiling rolls 20', 20", which in each case form a rolling gap 102 with a shape in longitudinal section which corresponds to that of the profile 12', 12" in the respective profiling step, is required for each of the profiling steps.

Figure 8:
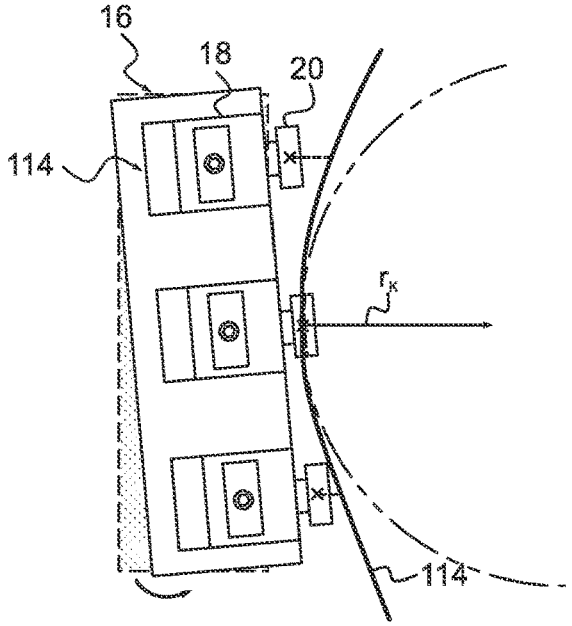
Fig. 8 (Prior Art)
FIG. 8 shows a simplified view of a profiling method known from the prior art with a desirable profile outer edge.

A plan view of a combination, known from the prior art, of a support device 16 and three profiling units 18 carried by it is shown in FIG. 8. It can be seen that, owing to the ability of the support device 16 to rotate, just one profiling unit 18 can always be optimally oriented with respect to the profile outer edge 114. However, when the curvature of the profile outer edge 114 is large (i.e. small radii of curvature $r_K$), it is not possible for all the profiling units to be oriented simultaneously with respect to the profile outer edge 114 such that optimal forming (or any forming at all) is possible.

Figure 9:
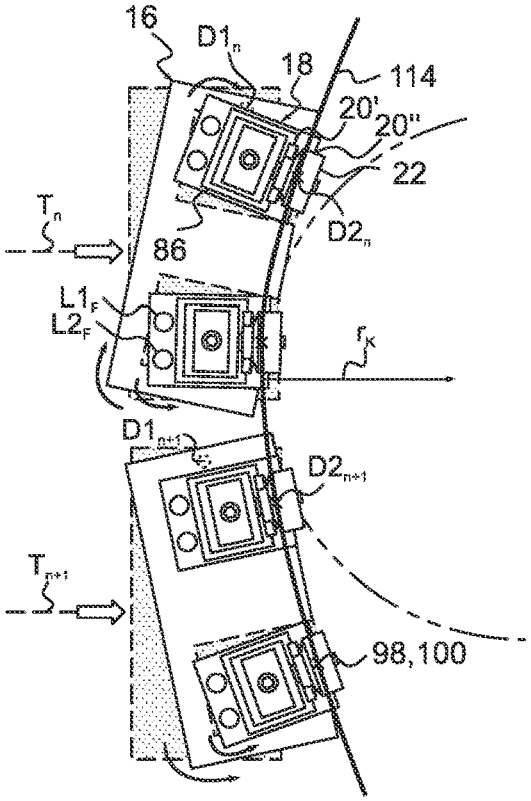
FIG. 9 shows the device according to the invention in a simplified plan view with a desirable profile outer edge.

In contrast thereto, FIG. 9 illustrates a detail of the device 10 according to the invention in a plan view. Because each pivot table 16 carries just two profiling units 18, which in addition can pivot individually, the device 10 as a whole has, with the same number of profiling units, significantly more degrees of freedom, which can be used to adapt the profiling units 18 to the profile outer edge 114, than conventional devices of this type. If it is assumed that the profiling units can be pivoted by any desired angle of pivoting, then two profiling units 18 on a pivot table 16 can be adapted to radii of curvature which can be almost as small as desired. In contrast, when, as in the prior art, three profiling units are fastened on a rotating table, this is not valid if it were likewise possible for the profiling units to pivot by any desired angle on the rotating table.

In order to achieve the adaptation shown in FIG. 9 of the position of the profiling units to the profile outer edge 114, a plurality of individual movements are performed one after the other or at the same time. The combination, shown above in FIG. 9, of a pivot table 16 and profiling units 18 executes, for example, the following movements:

1. A translational movement of the pivot table 16 toward the profile outer edge 114 to be profiled;
2. A pivoting movement of the pivot table 16 clockwise;
3. A pivoting movement of the upper of the two profiling units 18 clockwise; and
4. A pivoting movement of the lower of the two profiling units 18 counterclockwise.

The combination, shown below in FIG. 9, of a pivot table 16 and profiling units 18 executes, for example, the following relevant movements:

1. A translational movement of the pivot table 16 toward the profile outer edge 114 to be profiled;
2. A pivoting movement of the pivot table 16 counterclockwise;
3. A pivoting movement of the lower of the two profiling units 18 counterclockwise.

This sequence of movements has the effect of making the adaptation, shown by way of example in FIG. 9, of the profiling units 18 to the curvature of the profile outer edge 114.

In an embodiment not shown separately, it is possible to displace the pivot tables 16 in further directions of translational movement. It is also possible to design the pivot tables 16 in such a way that they can moreover pivot about an axis of rotation extending parallel to the profiling plane $E_P$ and in the direction of the conveying direction F. As a result, the pivot tables 16 and the profiling units 18 carried by them can be tilted toward the profiling plane $E_P$ or away therefrom.

The invention claimed is:

1. A device for flexible roll forming of a semifinished product to form a profile, the profile having a longitudinal axis and a cross-section, wherein the cross-section of the profile varies along the longitudinal axis, and/or a direction of the longitudinal axis varies, wherein the device comprises a frame, a plurality of support devices movably mounted on the frame, wherein each support device is configured to be translationally displaced and rotated relative to the frame, and a plurality of profiling units each comprising a holding structure and a pair of rotatably mounted rolls, between which there is a rolling gap, wherein the rolls are mounted to and configured to be rotated relative to the respective holding structure, wherein exactly two profiling units are arranged on each support device, wherein the profiling units are each configured to be rotated relative to the respective support device.

2. The device of claim 1, wherein at least one of the plurality of support devices is mounted for rotation about a first axis of rotation, which defines a first direction of rotation, and for translation parallel to a direction of translation, at least one of the plurality of profiling units is mounted for rotation about a second axis of rotation which defines a second direction of rotation, wherein the first direction of rotation intersects with the direction of translation at a first angle, and the second direction of rotation intersects with the direction of translation at a second angle, and wherein the second axis of rotation extends through a processing point located in the rolling gap between the pair of rotatably mounted rolls of the at least one profiling unit.

3. The device of claim 2, wherein each pair of rotatably mounted rolls comprises a first roll and a second roll differing from the first roll, the first roll and the second roll each have a first circumferentially extending forming section and a second circumferentially extending forming section, which is arranged axially offset to the first forming section, and wherein the processing point is arranged at a transition between the first forming section to the second forming section.

4. The device of claim 2, wherein each of the plurality of support devices is mounted in a supporting fashion on at least a first support device bearing portion and a support device bearing portion.

5. The device of claim 4, wherein each of the plurality of support devices comprises two first support elements, which provide the first support device bearing portion and the second support device bearing portion, and has a first rotating element defining the first axis of rotation and providing a third support device bearing portion.

6. The device of claim 4, wherein exactly two frame elements are arranged on each of the plurality of the support devices, and wherein each frame element provides for the profiling units at least two counter bearing portions differing from the first and second support device bearing portions.

7. The device of claim 2, wherein each of the plurality of profiling units is mounted in a supporting fashion on at least a first profiling unit bearing portion and a second profiling unit bearing portion.

8. The device of claim 7, wherein each of the plurality of support devices comprises two first support elements and each of the plurality of profiling units comprises two second support elements, which provide the first profiling unit bearing portion and a second profiling unit bearing portion, and has a second rotating element which defines the second axis of rotation and provides a third profiling unit bearing portion.

9. A method for flexible roll forming of a semifinished product to form a profile, the profile having a longitudinal axis and a cross-section, wherein the cross-section of the profile varies along the longitudinal axis, and/or a direction of the longitudinal axis varies, the method comprising the following steps:

a) providing a frame and a plurality of support devices movably mounted on the frame, wherein the support devices each have exactly two profiling units each having a holding structure and a pair of rotatably mounted rolls between which there is a rolling gap, wherein the rolls are mounted to and configured to be rotated relative to the respective holding structure; and b) displacing in translation and rotating the plurality of support devices relative to the frame and rotating the exactly two profiling units on and relative to the respective support device whilst the semifinished product is conveyed through the rolling gap in a conveying direction.

* * * * *